US005095689A

United States Patent [19]

Ferro et al.

[11] Patent Number: 5,095,689

[45] Date of Patent: Mar. 17, 1992

[54] METHOD AND DEVICE FOR REJOINING YARN WITH HIGH EFFICIENCY IN AN OPEN-END SPINNING MACHINE

[75] Inventors: Francesco Ferro; Claudio Peruch, both of Pordenone, Italy

[73] Assignee: Savio S.p.A., Pordenone, Italy

[21] Appl. No.: 666,997

[22] Filed: Mar. 11, 1991

Related U.S. Application Data

[63] Continuation of Ser. No. 409,683, Sep. 20, 1989, abandoned.

[30] Foreign Application Priority Data

Dec. 23, 1988 [IT] Italy ..... 23096 A/88

[51] Int. Cl.[5] ..... D01H 4/50

[52] U.S. Cl. ..... 57/263; 57/302; 57/411; 57/413

[58] Field of Search ..... 57/263, 302, 404, 405, 57/408, 411, 413, 415, 304

[56] References Cited

U.S. PATENT DOCUMENTS

| | | | |
|---|---|---|---|
| 3,354,626 | 11/1967 | Cizek et al. . | |
| 3,541,774 | 11/1970 | Sterba et al. . | |
| 3,698,174 | 10/1972 | Boucek et al. . | |
| 3,728,853 | 4/1973 | Schiltknecht . | |
| 3,810,352 | 5/1974 | Miyazaki et al. | 57/302 X |
| 3,908,134 | 9/1975 | Mikulechy et al. . | |
| 3,950,926 | 4/1976 | Stahlecker | 57/263 |
| 3,987,610 | 10/1978 | Stahlecker et al. . | |
| 4,022,011 | 7/1967 | Hirai . | |
| 4,384,451 | 5/1983 | Elias et al. | 57/263 |
| 4,429,522 | 2/1984 | Ferkl et al. | 57/411 X |
| 4,497,166 | 2/1985 | Artzt et al. | 57/263 |
| 4,676,059 | 6/1987 | Artzt et al. | 57/263 |

FOREIGN PATENT DOCUMENTS

| | | | |
|---|---|---|---|
| 311946 | 4/1989 | European Pat. Off. | 57/411 |
| 3436295 | 10/1984 | Fed. Rep. of Germany . | |
| 2260644 | 2/1975 | France . | |
| 1074788 | 7/1967 | United Kingdom . | |
| 2069014 | 8/1981 | United Kingdom . | |
| 86/01235 | 2/1986 | World Int. Prop. O. . | |

*Primary Examiner*—Jospeh J. Hail, III
*Attorney, Agent, or Firm*—Shea & Gould

[57] ABSTRACT

A method for rejoining yarn in an open-end spinning machine in which the rejoining is effected by feeding intact fibres to the rotor but preceding the rejoining by an operation in which the sliver is cleared and the carder is cleaned by the high-vacuum suction nozzle brought into correspondence with the air intake port.

8 Claims, 2 Drawing Sheets

9
10
10
14
13
12
15
8
17
2
11
1
16
17
5
6
4
7
18
3

METHOD AND DEVICE FOR REJOINING YARN WITH HIGH EFFICIENCY IN AN OPEN-END SPINNING MACHINE

FIELD OF THE INVENTION

This application is a continuation of Ser. No. 409,683 filed Sept. 20, 1989 and now abandoned.

This invention relates to a method of yarn rejoining in open-end spinning machines, and more particularly to a method of preparing the fibre sliver which forms the feed before joining or rejoining the yarn to enable spinning to restart.

BACKGROUND OF THE INVENTION

The open-end spinning process consists essentially of the following stages:

- feeding the fibre sliver to the spinning station by a feed roller;
- separating the sliver by a toothed carder which rotates at high speed and separates the sliver into individual fibres;
- pneumatically feeding the individual fibres to the hollow spinning rotor which is provided with an inner groove within which the fibres are deposited in layers by the effect of the centrifugal force generated by the rotor rotating at very high speed;
- an already formed yarn is initially inserted through the a channel located substantially on the axis of rotation of the rotor, centrifugal force propelling its free end to the periphery, i.e. into the groove where it encounters the fibre layer; on drawing out the yarn the fibres become joined to the yarn, acquiring twist in the section between the groove and the exit channel to produce new yarn.

In the known art the spinning machine is provided with yarn-feeling sensors which for every yarn breakage cause the fibre sliver feed roller to stop, as for example, in Italian Patent No. 791,993 of VUB.

However the separating carder continues to rotate even if yarn production is interrupted.

In the known art the method used for rejoining the yarn and restarting production comprises firstly cleaning the spinning rotor, in which irregularities or dirt build-up have probably occurred.

This cleaning is done either by opening the rotor, clamping it and then using suitable tools such as brushes, suction nozzles, spatulas etc., or by keeping the rotor closed and using an air blast.

After cleaning, a fibre layer suitable for forming new yarn is rebuilt in the spinning rotor while under movement, and the interrupted yarn end is reinserted when the rotor has reached suitable speed, to "fish out" this fibre layer and again produce yarn.

This operation is conducted either manually, in non-automated spinning machines, or automatically by devices located for example on mobile carriages which patrol the plurality of spinning stations along the machine face in the case of automated machines, as described in U.S. Pat. Nos. 3,810,352 and 3,950,926.

A technical problem common to both automated and non-automated spinning machines is that the fibre feed sliver which has been halted on yarn breakage, with its feed roller at rest, remains with its end exposed to the action of the separating carder. Generally, the rejoining operation is commenced with variable delay because the rejoining operation requires in the case of non-automated spinning machines the operator, or in the case of automated spinning machines the carriage, to arrive in front of the spinning station at which the operation is to be carried out. The operator or carriage can be a variable distance away, or may be engaged in other operations.

During this variable waiting time the end of the feed sliver continues to undergo separation, without advancing, and is depleted of fibres, which are gradually removed by the carder teeth.

When the sliver is reused in that state for restarting the spinning, the fibre layer newly deposited in the rotor groove and used for rejoining purposes gives rise to thinner or fatter weakened portions and thus an irregular joint, with the result that the produced yarn is of poor quality.

Figure 1:
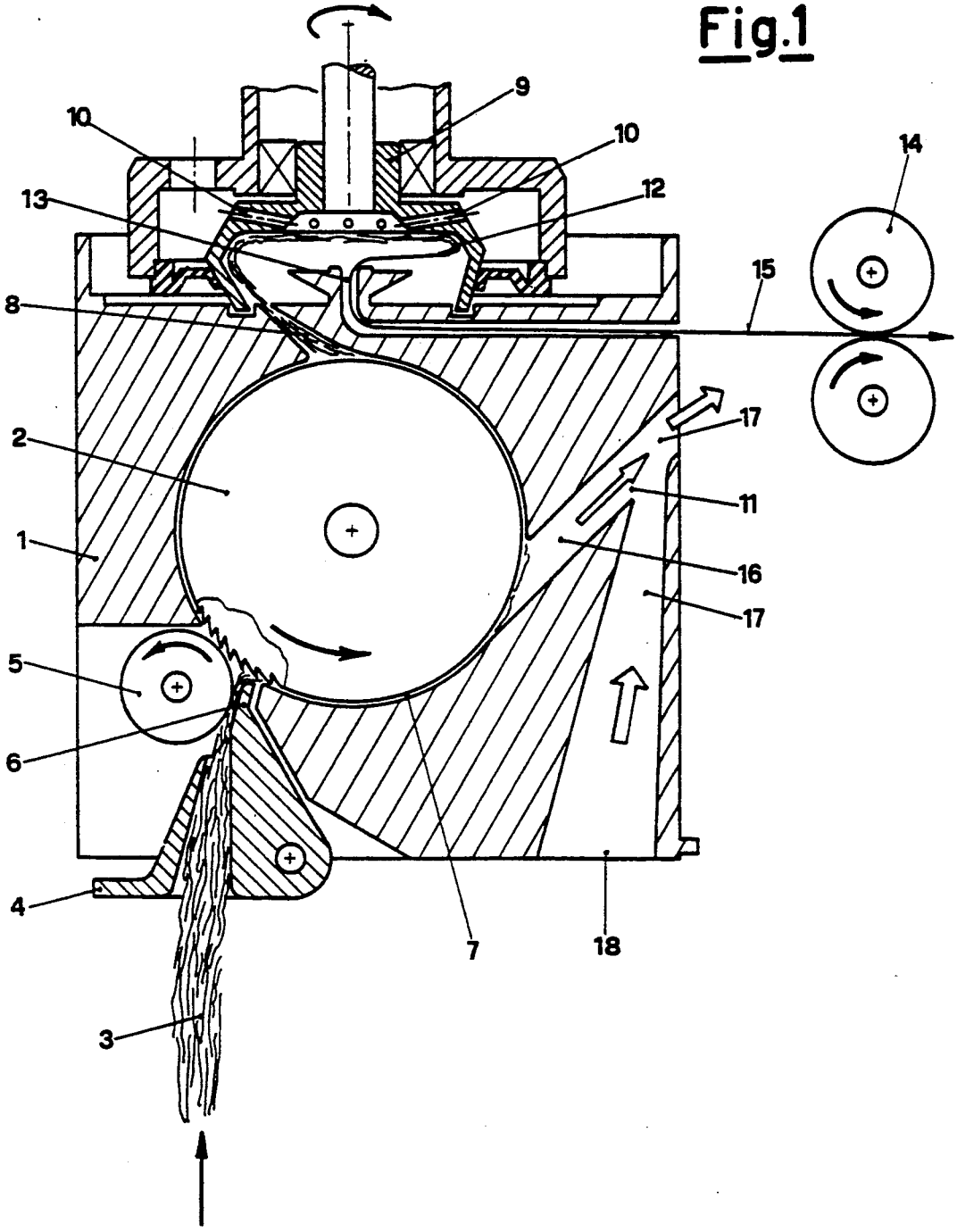
FIG. 1 is a side view of the device of the invention showing the direction of air flow through the device during operation.

The sliver depletion varies in accordance with the waiting time for commencing the operation, and the layer initially deposited in the rotor groove consequently varies.

According to the known art this variability in the consistency of the fibre sliver re-fed to spinning is overcome by means of a brief prefeed of sliver during the initial stage of the rejoining operation. This prefeed enables the state of the sliver to be equalized by consuming that portion of sliver which in the meantime has remained exposed to the action of the carder, so restoring the state of the sliver as if the yarn breakage had taken place at the moment the rejoining operation commences.

This prefeed operation to equalize the state of the sliver end which is to be used for rejoining the yarn must necessarily be effected after the arrival of the operator or mobile carriage but before the rotor cleaning operation. The fibres removed from the deteriorated sliver during the waiting time for the operation are deposited in the rotor groove and are removed from there by the subsequent cleaning, whereas if the preliminary feed were to be effected after the rotor cleaning, this latter would not accomplish its purpose because uncontrolled depositing of other fibres would take place in the cleaned rotor.

Again, if the prefeed were to be effected with the rotor open it would give rise to unacceptable soiling.

The practice of prefeed goes back to the first open-end spinning machines and was already described in the book Open-End Spinning by Rohlena et al., 1974, pages 323 onwards, as a preliminary stage.

According to Italian Patent No. 1,045,600 in the name of Stahlecker, this prefeed is effected during the braking of the spinning rotor.

In this patent the sliver feed roller is operated for prefeed purposes by an auxiliary motor positioned on the mobile carriage because during the rejoining operation this feed roller is disconnected from its normal drive, which is used only during spinning.

The practice of pre-feeding the sliver, whether effected as the preliminary stage of the rejoining cycle or during rotor braking, satisfies its purposes of equalizing the state of the sliver re-fed to enable spinning to resume by the rejoining operation, but does not completely solve the problem of its deterioration. In this respect it must be remembered that after the equalization to produce a constant sliver not influenced by the variable waiting time for the commencement of the rejoining operation, the sliver remains at rest and exposed to the action of the carder, which continues to rotate, for the time period between the sliver prefeed and the return to normal feeding to deposit the new fibre layer for rejoining purposes.

The duration of this time interval is rigorously constant in the case of automated spinning machines in which the rejoining operation is robotized and generally carried out by a mobile carriage, and substantially constant where the operation is carried out by an operator who has acquired sufficient manual ability.

During this constant time interval the sliver is subjected to deterioration by the carder. This deterioration is a drawback which is not very important from the point of view of the quantity of residual fibres present in the sliver end because this can be remedied by controlling the time interval between the restoration of sliver feed and the "fishing out" of the fibre layer in the rotor cavity by the yarn end.

This drawback cannot however be totally overlooked from the point of view of the quality of the residual fibres present in the sliver end.

It must be remembered that the duration of the interval between prefeed and restoration of spinning in current automated open-end spinning machines is of the order of 10 seconds, and the carder has therefore a considerable time available for this deterioration action on the end of the halted sliver.

In this respect it has been found that one of the most important caused of defective joining, even using the prefeed practice, is that the sliver end, which remains subjected to the action of the carder for the entire duration of the said interval, is also subjected to qualitative deterioration because the sliver fibers are not only removed but also shortened, so that the new fibre layer deposited in the rotor cavity on restoring the sliver feed and which is used for the actual rejoining is formed from fibres of inferior quality as it also comprises a considerable amount of fibres shortened by the action of the carder rotating on the sliver which is at rest during the waiting time for the rejoining. This drawback is particularly marked if fine yarns of high metric count are produced, for which the prefeed practice does not allow a reliable joint of good quality. The joining operation must be frequently repeated because the joint is either not made or breaks.

In Italian Patent Nos. 1,169,043 and 1,178,550 of V.U.B. it is proposed to firstly deviate during the rejoining operation those fibres of the damaged portion of the sliver exposed to the action of the carder during the waiting period by not allowing them to reach the spinning rotor, so allowing the spinning rotor to receive only the undamaged fibers of the sliver portion which was not under the action of the separating carder while at rest.

According to Italian Patent No. 1,169,043 this deviation is done by suction channels which open into the pneumatic conveying path which the fibres separated by the carder take in travelling to the rotor, and by blowing nozzles which act against the normal movement of the fibres towards the rotor.

This device results in considerable complications both in the spinning device and in its operation.

In the subsequent Italian Patent No. 1,178,550 the deviation is done by using the aperture in the duct tangential to the carder to remove the impurities. The impurities, such as dust, sand and dirt, are more subject to the action of centrifugal force as they are heavier and more compact than the separated fibres.

The impurities are thus projected outwards through this tangential duct which connects to a suction manifold in which a slight vacuum is maintained sufficient to induce an air stream powerful enough to convey the impurities but not to suck the fibres from the carder.

This vacuum is by way of example a few tens of mm. of water column or a few mm. of mercury expressed as static vacuum.

The various suction manifolds converge into a large central duct under vacuum which collects all impurities and conveys them to a collection box and distributes the suction to the various spinning units. According to U.S. Pat. No. 1,178,550 a tubular suction nozzle is inserted into the suction manifold until is mouth engages the aperture of the tangential duct to shut off the suction manifold, and after it has been inserted in position the suction is applied to the damaged fibres.

This method is not free of drawbacks because the suction nozzle carried by the service carriage must be carefully constructed and positioned with great accuracy relative to the spinning station, and in addition travels a long distance in positioning itself and withdrawing, so extending the duration of the rejoining cycle. In addition there is disturbance to the initial spinning conditions, both due to the lack of suction for the impurities precisely during and immediately after the rejoining operation when the suction nozzle withdraws to its rest position to again engage the frontal air intake port, and due to the consequent pressure pulsations which arise when the air intake port is released.

SUMMARY OF THE INVENTION

The present invention provides a device and improved method of rejoining yarn in an open-end spinning machines which enables the rotor to be supplied with totally intact and impurity-free fibres for the rejoining operation.

Figure 2:
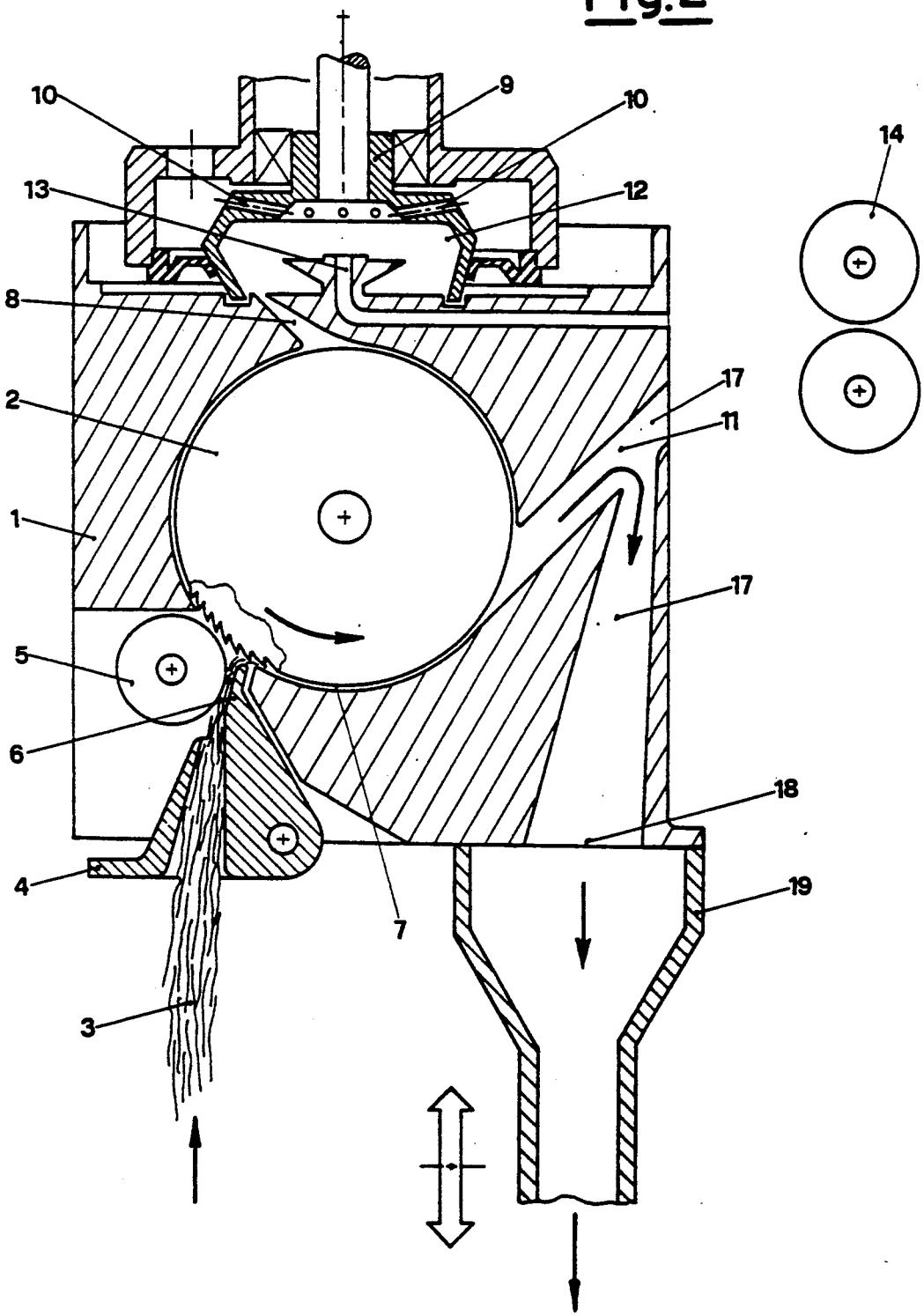
FIG. 2 is a side view of the device of the invention showing the direction of air flow through the device when suction is applied to the device.

The device and method are described with reference to FIG. 1 which shows a spinning unit during its normal operation, and FIG. 2 which shows the spinning unit during the rejoining cycle.

DETAILED DESCRIPTION OF THE INVENTION

The spinning unit consists of a fixed support or housing 1 in which the rotary carder 2 is positioned, provided along its outer cylindrical surface with saw-toothing to separate the fibres of the feed sliver.

The fibre sliver 3, originating from an underlying chamber not shown on the figure, is fed along a fixed guide 4 by the feed roller 5 which rotates in an anticlockwise direction in order to feed the sliver towards the carder 2. The feed roller 5 is preferably provided with knurling on its cylindrical surface to increase the dragging effect on the sliver, contact between the sliver 3 and roller 5 being ensured by an approach member 6 the surface of which is kept in proximity to, but in contact with, the cylindrical surface of the roller 5 by a suitable pneumatic or elastic device not shown on the figure, so that the sliver 3 is guided into contact with the cylindrical surface of the roller 5. In the practical embodiment the approach member 6 is a sliding block with a concave surface facing the roller 5.

In this manner the sliver 3 is fed to the carder 2, which separates it into individual fibres. The individual fibres travel through the interspace 7 surrounding the carder 2 and are conveyed pneumatically through the channel 8 to the cavity of the rotor 9, which rotates at very high speed.

A vacuum is generated within the cavity of the rotor 9 by the effect of its speed and the perforations 10, or by the action of a separate suction source, and sucks the fibres separated by the carder 2, withdrawing air both from the interspace 7 and channel 8 through the aperture 11.

Inside the rotor 9 the fibres are subjected to high centrifugal force and are urged towards the periphery where they collect in the annular groove 12 to form a layer of suitable size. An already formed yarn is then inserted through the channel 13 at the commencement of spinning. Its free end is urged by centrifugal force to the periphery of the rotor where it encounters the fibre layer, the yarn then being withdrawn for example by a pair of rollers 14. The fibres join to the inserted yarn and acquire twist along the path between the annular groove and the axis of the rotor 9, where the exit channel 13 is located.

The produced yarn 15 is extracted and collected in packages or bobbins by a collection system, not shown on the figure. The impurities which escape the carder 2 are discharged by centrifugal force from the aperture 11, which connects the tangential duct 16 to the suction manifold 17. Conveying air is drawn into the manifold 17 through the air intake port 18 of the front face 21 of the housing 1 by the effect of the vacuum downstream of the manifold 17, indicatively about 50 mm of water, in the direction of the light arrows.

When a breakage occurs in the yarn 15, a sensor not shown on the figure causes the feed roller 5 to stop and halts collection of the yarn 15 in known manner.

The yarn-feeling sensor also calls the service carriage to the spinning station in which yarn breakage has taken place, to effect the yarn rejoining operations in accordance with the cycle described heretofore.

During the intervention cycle the roller 5 remains at rest and the end of the sliver 3 is progressively depleted and degraded by the carder 2, which continues to rotate.

At the same time the rotor 9 is halted to enable its grove 12 to be cleaned. Thus the pneumatic conveying action in the duct 10 which sucks the fibres from the duct 8 to the rotor 9 ceases, and the fibres removed from the sliver by the rotary carder at least partly remain on the carder and in the interspace 7.

According to the present invention, for the yarn rejoining operation a high-vacuum suction nozzle 19 carried on the service carriage is brought into correspondence with the air intake port 18 and is able to approach and withdraw from the spinning unit in accordance with the double-direction light arrows. As illustrated in FIG. 2 the nozzle 19 is moved into contact with the face 21 and into sealing engagement with the port 18 essentially only at the face 21.

When the rotor has been cleaned and before returning it to the speed at which the new fibre layer is to be deposited for the actual rejoining operation, an energetic suction action in the direction of the dark arrows is initiated by a solenoid valve, not shown on the figure but connected into the duct containing the nozzle 19, under a vacuum much higher than that maintained in 17 during normal operation. The levels of static vacuum which enable a good joint to be made are indicatively between 300 and 900 mm of water and preferably between 450 mm and 700 mm.

This energetic suction action allows removal from the carder 2 and interspace 7 of all the fibres deposited there during the stages preceding the intervention cycle, is those in which the sliver was deteriorated by the action of the carder 2.

Immediately afterwards, the sliver 3 is again fed by the roller 5 to the carder 2 while maintaining the interspace 7 under energetic suction, and the rotor is restarted.

The deteriorated fibres present at the end of the sliver are thus combed away by the carder 2, and drawn towards the aperture 11 and nozzle 19. After the deteriorated portion has been removed, the suction action of the nozzle 19 is shut off and the nozzle 19 can be moved away from the face 21, to restore normal vacuum in 17.

The fibres separated by the carder 2 again flow to the rotor 9, which in the meantime has reached the required speed for depositing the new layer of fibres and has restored its pneumatic sucking action through the duct 8.

The fibres thus fed to the rotor 9 are perfectly intact and allow a better quality of joint.

As can be seen, the nozzle 19 does not have to travel long distances or be accurately positioned. Sealing is ensured by a soft annular gasket.

The time required for cleaning the carder 2 and interspace 7 and for removing the damaged fibres from the sliver is very short, with an indicative total of less than 7 seconds.

Using the method of the invention, high-efficiency joints have been obtained even on fine yarns, with a metric count of 40–80, to the extent of more than 95% as shown by subjecting them to joint tests; In the case of medium yarns, this efficiency reached 99%.

We claim:

1. An open end spinning machine including spinning and service units for forming yarn from fibers and for rejoining yarn to the fibres when the yarn breaks;

wherein the spinning unit for forming yarn comprises:

a) a housing having a chamber therein and a face portion directly open to the surrounding environment;

b) a feed mechanism in said housing for feeding sliver into the spinning unit, wherein the sliver contains impurities and fibers and wherein said feed mechanism is adapted to be halted when the yarn breaks to thereby halt the feeding of the sliver;

c) a rotatable carder in said chamber of said housing for receiving the sliver from said feed mechanism and for separating the sliver into said fibers, and wherein said carder continues to rotate during a yarn break and thereby damages fibers in the halted sliver;

d) a spinning rotor adjacent said housing having air withdrawing means associated therewith for receiving the separated fibers from said rotatable carder and for depositing layers of fibers therein for forming yarn and for rejoining yarn therein when the yarn breaks; and e) channel means in said housing connected to said chamber upstream of said spinning rotor and downstream of said feed mechanism, wherein said channel means is utilized for removal of impurities in said chamber from the sliver and for the removal of damaged fibers from the halted sliver and wherein said channel means includes a port at said face portion of said housing directly open to the surrounding environment for effecting an air flow from said channel sufficient to allow removal of impurities and to remove damaged fibers from said carder and chamber; and wherein the service unit for servicing said spinning unit when yarn breaks and is to be rejoined to fibers in said rotor, includes a suction nozzle mechanism which contacts with said face portion of said housing and seals with said port thereat essentially only at said face portion, wherein said suction nozzle mechanism is operable at a vacuum sufficiently greater than said air withdrawing means during a yarn break to deflect fibres damaged by said rotatable carder away from said rotor, and wherein said suction nozzle mechanism ceases operation at the described vacuum after said sliver feed has been commenced, to thereby allow undamaged fibres to reach said rotor for rejoining with yarn therein while impurities are concurrently removed from said chamber of the fiber generating sliver through said channel means prior to reaching said spinning rotor.

2. An open end spinning machine including spinning and service units for forming yarn from the fibers and for rejoining yarn to the fibers when the yarn breaks; wherein the spinning unit for forming yarn comprises:

a) a housing having a chamber therein and a face portion directly open to the surrounding environment;

b) a feed mechanism in said housing for feeding sliver into the spinning unit, wherein the sliver contains impurities and fibers and wherein said feed mechanism is adapted to be halted when the yarn breaks to thereby halt the feeding of the sliver;

c) a rotatable carder in said chamber of said housing for receiving the sliver from said feed mechanism and for separating the sliver into said fibers, and wherein said carder continues to rotate during a yarn break and thereby damages fibers in the halted sliver;

d) a spinning rotor adjacent said housing having air withdrawing means associated therewith for receiving the separated fibers from said rotatable carder and for depositing layers of fibers therein for forming yarn and for rejoining yarn therein when the yarn breaks; and e) channel means in said housing including a first channel extending from said chamber and through said channel means, a second channel in said channel means connected to said first channel at an intermediate point thereof, and a port in said channel means connected to said second channel and at said face portion of said housing directly open to the surrounding atmospheric environment, wherein the centrifugal force of said rotatable carder and the suction of air from said chamber to the surrounding atmospheric environment via said first channel causes impurities in the sliver being separated into fibers by said rotatable carder to be removed during the formation of yarn; and wherein the service unit for servicing said spinning unit when yarn breaks and is to be rejoined to fibers in said cleaned rotor comprises a suction nozzle mechanism which is movable into contact with said face portion of said housing and into sealing engagement with said port thereat essentially only at said face portion and is operable at a vacuum sufficiently greater than the air withdrawing means to deflect fibers damaged by said rotatable carder away from said spinning rotor after a yarn break, and wherein said suction nozzle mechanism is movable away from said port at said face portion after said sliver feed has again commenced to thereby allow undamaged fibres to reach said cleaned rotor ready for rejoining with yarn therein while impurities are concurrently removed from said chamber from the fiber generating sliver through said first channel means prior to reaching said spinning rotor.

3. A method of forming yarn from fibers and of rejoining yarn to the fibers when the yarn breaks in an open end spinning machine having spinning and service units comprising:

a) feeding sliver containing impurities and fibers into a housing of the spinning unit by a feed mechanism and halting the feed mechanism when the yarn breaks to halt the feeding of the sliver, and wherein the housing has a face portion directly open to the surrounding atmospheric environment;

b) receiving the sliver from the feed mechanism and separating the received sliver into fibers by a rotatable carder in a chamber of the housing of the spinning unit, wherein the rotatable carder continues to rotate and thereby damage the halted sliver during a yarn break;

c) receiving the separated fibers from the rotatable carder and depositing layers of fibers in a spinning rotor adjacent the housing of the spinning unit having air withdrawal means associated therewith for forming yarn and for rejoining yarn when the yarn breaks;

d) effecting the air flow from channel means in the housing wherein the channel means is connected to the chamber upstream of the spinning rotor and downstream of the feed mechanism for removal of impurities in the chamber from the sliver and for removal of damaged fibers from the halted sliver, and wherein the channel means includes a port at the face portion of the housing directly open to the surrounding environment; and e) operating a suction nozzle mechanism of the service unit which contacts the front portion of the housing and seals with the port thereat essentially only at the face portion during a yarn break at a vacuum sufficiently greater than the air withdrawing means to deflect fibers damaged by the rotatable carder away from the rotor, and ceasing the operation of the suction nozzle engagement by said vacuum after the feeding mechanism again commences to feed sliver, to thereby allow undamaged fibers to reach the rotor for rejoining with yarn therein while impurities are concurrently removed from the chamber of the fiber generating sliver through the channel means prior to reaching the spinning rotor.

4. A method of forming yarn from fibers and of rejoining yarn to the fibers when the yarn breaks in an open end spinning machine including spinning and service units comprising:

a) feeding sliver containing impurities and fibers into a housing of the spinning unit by a feed mechanism and halting the feed mechanism when the yarn breaks to halt the feeding of the sliver, and wherein the housing has a face portion directly open to the surrounding atmospheric environment;

b) receiving the sliver from the feed mechanism and separating the received sliver into fibers by a rotatable carder in a chamber of the housing of the spinning unit, wherein the rotatable carder continues to rotate and thereby damages the halted sliver during a yarn break;

c) receiving the separated fibers from the rotatable carder and depositing layers of fibers in a spinning rotor adjacent the housing of the spinning unit having air withdrawal means associated therewith for forming yarn and for rejoining yarn when the yarn breaks;

d) applying a centrifugal force to the sliver by the rotatable carder and withdrawing air from the chamber to the surrounding atmospheric environment from a channel means, wherein the channel means includes a first channel extending from the chamber and through the channel means, a second channel in the channel means connected to the first channel, and a port in the channel means connected to the second channel and at the face portion of the housing directly open to the surrounding atmospheric environment, wherein the centrifugal force of the rotatable carder and the suction of air from the chamber to the surrounding atmospheric environment via the first channel causes impurities in the sliver being separated into fibers by the rotatable carder to be removed during the formation of yarn; and e) moving a suction nozzle mechanism of the service unit into contacts the face portion of the housing and sealing with the port thereat essentially only at the face portion, operating the suction nozzle mechanism at a vacuum sufficiently greater than the air withdrawal means to deflect damaged fibers away from the spinning rotor and into the suction nozzle mechanism after a yarn breaks, and disengaging and moving the suction nozzle mechanism away from the face portion and port after the sliver feed has again commenced to thereby allow undamaged fibers to be received by the cleaned rotor for rejoining with yarn therein while impurities are concurrently removed from the chamber of the fiber generating sliver through the first channel prior to reaching the spinning rotor.

5. The method of claim 3 or 4, further comprising starting removing fibers by said suction nozzle mechanism prior to the rotor reaching full operational speed and prior to the feeding mechanism feeding sliver to the carder, and operating said suction nozzle mechanism until the rotor has reached the speed at which fibers are fed from the carder.

6. The method of claim 3 or 4, wherein the air withdrawn through the channel creates a vacuum in said channel means in the range of about 300 to about 900 mm of water.

7. The method of claim 6, wherein the air withdrawn through said first port means creates a vacuum in said channel means in the range of about 450 to about 700 mm of water.

8. The method of claims 3 or 4, wherein said suction nozzle mechanism is operated for from 1 to 7 seconds.

* * * * *